US006425711B1

(12) United States Patent
Kiter

(10) Patent No.: US 6,425,711 B1
(45) Date of Patent: Jul. 30, 2002

(54) COMBINATION STEP AND RAMP APPARATUS FOR FLOATING DOCKS

(76) Inventor: Terry R. Kiter, 243 Poplar Crest Ave., Thousand Oaks, CA (US) 91320

( * ) Notice: Subject to any disclaimer, the term of this patent is extended or adjusted under 35 U.S.C. 154(b) by 13 days.

(21) Appl. No.: 09/648,236

(22) Filed: Aug. 25, 2000

(51) Int. Cl.[7] ..... E02B 3/20
(52) U.S. Cl. ..... 405/218; 405/220
(58) Field of Search ..... 405/218, 219, 405/221, 220; 114/362, 263; 182/86, 91, 97, 104, 200; 14/71.1, 69.5

(56) References Cited

U.S. PATENT DOCUMENTS 1,215,827 A * 2/1917 Lord
3,988,579 A * 10/1976 Howard et al. ..... 182/189
4,157,742 A 6/1979 Aanensen
4,253,547 A 3/1981 Skaalen et al.
4,303,145 A 12/1981 Vazquez
4,366,591 A 1/1983 Zimmerman
D358,924 S 5/1995 Achenbach
5,454,196 A * 10/1995 Gaines et al. ..... 52/183
5,553,421 A * 9/1996 Stratford ..... 52/182
5,634,440 A 6/1997 Mogck
5,794,292 A * 8/1998 Ricci, Jr. ..... 14/69.5

* cited by examiner

*Primary Examiner*—Thomas B. Will
*Assistant Examiner*—Raymond Addie

(57) ABSTRACT

A combination step and ramp apparatus for floating docks for providing safety for boaters ascending and descending the floating dock. The combination step and ramp apparatus for floating docks includes a pair of elongate step support members being spaced apart with each of the elongate step support members having a top end and a bottom end; and also includes a bracket assembly being securely attached to the elongate step support members and being adapted to be hingedly attached to a boat landing for allowing the elongate step support members to pivot about the boat landing; and further includes a plurality of step members being laterally spaced along a length of the elongate step support members with each of the step members having a front end and a back end which is pivotally attached to the elongate step support members and with each front end of a respective step member being adjustable such that the step member maintains a generally horizontal orientation; and also includes a step adjustment assembly for adjusting the step members.

18 Claims, 4 Drawing Sheets

COMBINATION STEP AND RAMP APPARATUS FOR FLOATING DOCKS

BACKGROUND OF THE INVENTION

1. Field of the Invention

The present invention relates to a floating dock step and ramp apparatus and more particularly pertains to a new combination step and ramp apparatus for floating docks for providing safety for boaters ascending and descending the floating dock.

2. Description of the Prior Art

The use of a floating dock step and ramp apparatus is known in the prior art. More specifically, a floating dock step and ramp apparatus heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,634,440; U.S. Pat. No. 4,253,547; U.S. Pat. No. 4,303,145; U.S. Pat. No. 4,366,591; U.S. Pat. No. Des. 358,924; and U.S. Pat. No. 4,157,742.

While these devices fulfill their respective, particular objectives and requirements, the aforementioned patents do not disclose a new combination step and ramp apparatus for floating docks. The inventive device includes a pair of elongate step support members being spaced apart with each of the elongate step support members having a top end and a bottom end; and also includes a bracket assembly being securely attached to the elongate step support members and being adapted to be hingedly attached to a boat landing for allowing the elongate step support members to pivot about the boat landing; and further includes a plurality of step members being laterally spaced along a length of the elongate step support members with each of the step members having a front end and a back end which is pivotally attached to the elongate step support members and with each front end of a respective step member being adjustable such that the step member maintains a generally horizontal orientation; and also includes a step adjustment assembly for adjusting the step members.

In these respects, the combination step and ramp apparatus for floating docks according to the present invention substantially departs from the conventional concepts and designs of the prior art, and in so doing provides an apparatus primarily developed for the purpose of providing safety for boaters ascending and descending the floating dock.

SUMMARY OF THE INVENTION

In view of the foregoing disadvantages inherent in the known types of floating dock step and ramp apparatus now present in the prior art, the present invention provides a new combination step and ramp apparatus for floating docks construction wherein the same can be utilized for providing safety for boaters ascending and descending the floating dock.

The general purpose of the present invention, which will be described subsequently in greater detail, is to provide a new combination step and ramp apparatus for floating docks which has many of the advantages of the floating dock step and ramp apparatus mentioned heretofore and many novel features that result in a new combination step and ramp apparatus for floating docks which is not anticipated, rendered obvious, suggested, or even implied by any of the prior art floating dock step and ramp apparatus, either alone or in any combination thereof.

To attain this, the present invention generally comprises a pair of elongate step support members being spaced apart with each of the elongate step support members having a top end and a bottom end; and also includes a bracket assembly being securely attached to the elongate step support members and being adapted to be hingedly attached to a boat landing for allowing the elongate step support members to pivot about the boat landing; and further includes a plurality of step members being laterally spaced along a length of the elongate step support members with each of the step members having a front end and a back end which is pivotally attached to the elongate step support members and with each front end of a respective step member being adjustable such that the step member maintains a generally horizontal orientation; and also includes a step adjustment assembly for adjusting the step members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination step and ramp apparatus for floating docks which has many of the advantages of the floating dock step and ramp apparatus mentioned heretofore and many novel features that result in a new combination step and ramp apparatus for floating docks which is not anticipated, rendered obvious, suggested, or even implied by any of the prior art floating dock step and ramp apparatus, either alone or in any combination thereof.

It is another object of the present invention to provide a new combination step and ramp apparatus for floating docks which may be easily and efficiently manufactured and marketed.

It is a further object of the present invention to provide a new combination step and ramp apparatus for floating docks which is of a durable and reliable construction.

An even further object of the present invention is to provide a new combination step and ramp apparatus for floating docks which is susceptible of a low cost of manufacture with regard to both materials and labor, and which accordingly is then susceptible of low prices of sale to the consuming public, thereby making such combination step and ramp apparatus for floating docks economically available to the buying public.

Still yet another object of the present invention is to provide a new combination step and ramp apparatus for floating docks which provides in the apparatuses and methods of the prior art some of the advantages thereof, while simultaneously overcoming some of the disadvantages normally associated therewith.

Still another object of the present invention is to provide a new combination step and ramp apparatus for floating docks for providing safety for boaters ascending and descending the floating dock.

Yet another object of the present invention is to provide a new combination step and ramp apparatus for floating docks which includes a pair of elongate step support members being spaced apart with each of the elongate step support members having a top end and a bottom end; and also includes a bracket assembly being securely attached to the elongate step support members and being adapted to be hingedly attached to a boat landing for allowing the elongate step support members to pivot about the boat landing; and further includes a plurality of step members being laterally spaced along a length of the elongate step support members with each of the step members having a front end and a back end which is pivotally attached to the elongate step support members and with each front end of a respective step member being adjustable such that the step member maintains a generally horizontal orientation; and also includes a step adjustment assembly for adjusting the step members.

Still yet another object of the present invention is to provide a new combination step and ramp apparatus for floating docks that easily and effectively adjusts the step members as the floating docks rise and sink relative to the boat landing.

Even still another object of the present invention is to provide a new combination step and ramp apparatus for floating docks that is adaptable to different shoreline requirements.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
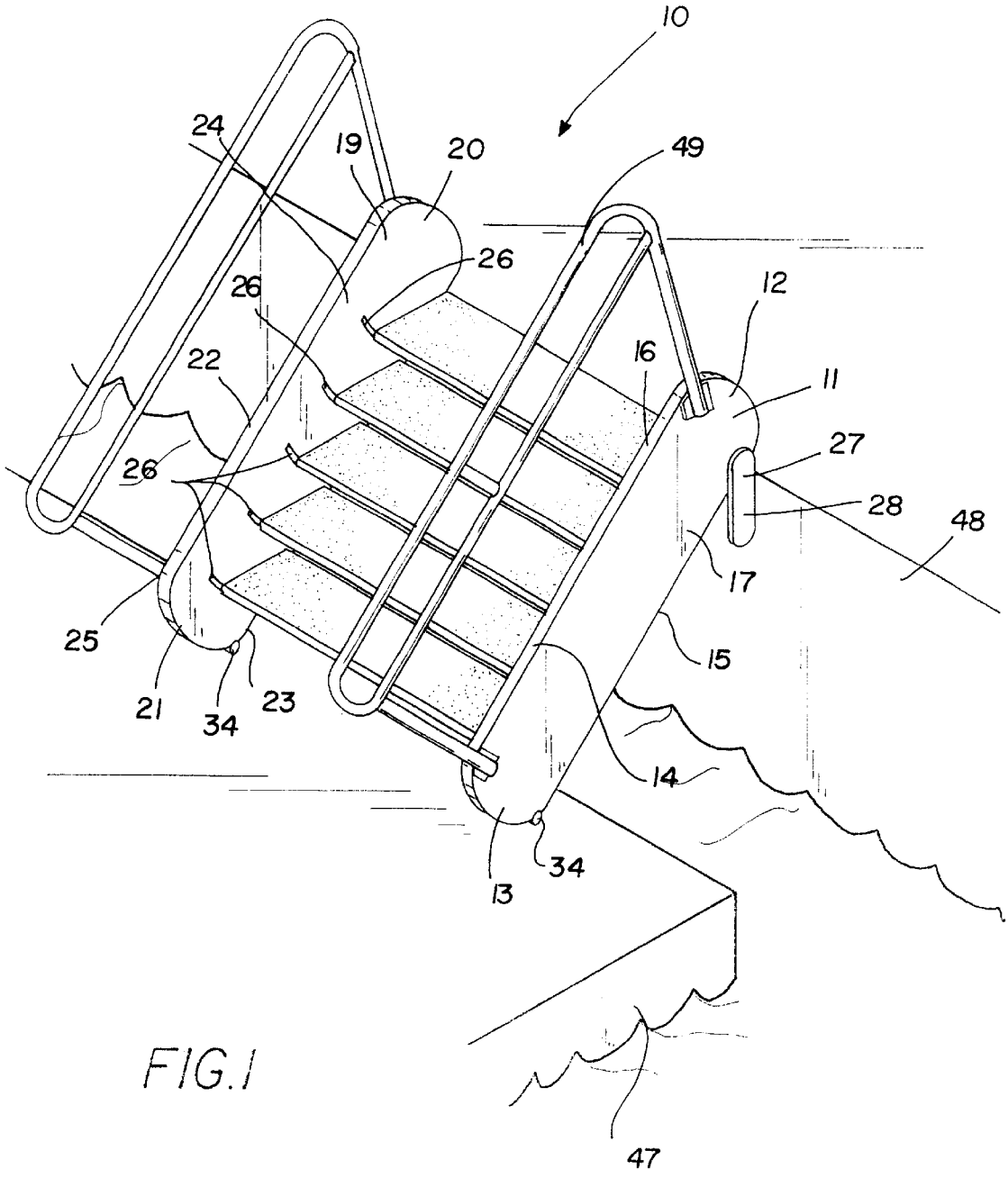
FIG. 1 is a perspective view of a new combination step and ramp apparatus for floating docks according to the present invention.
Figure 2:
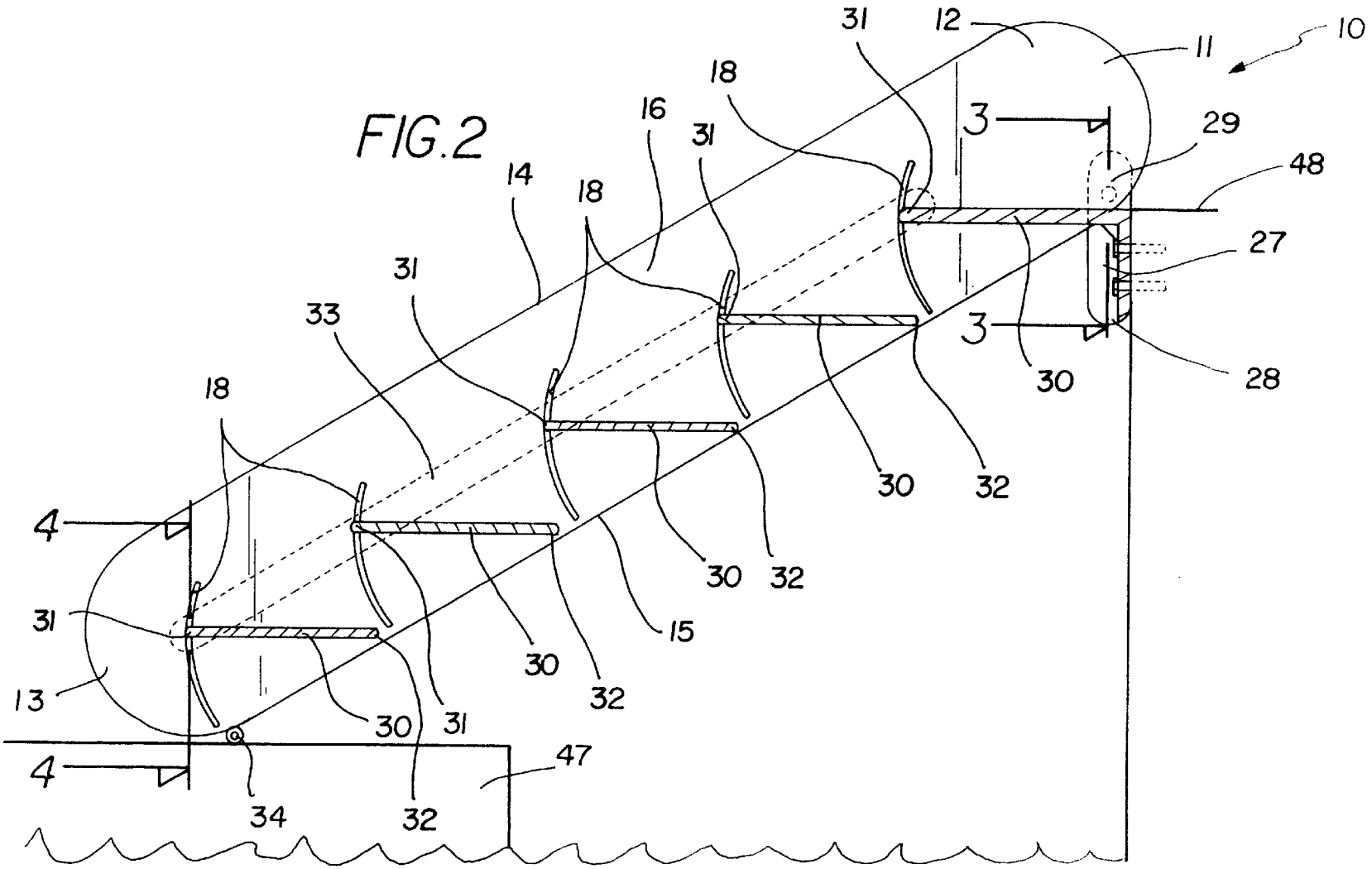
FIG. 2 is a cross-sectional view of the first embodiment of the present invention.
Figure 3:
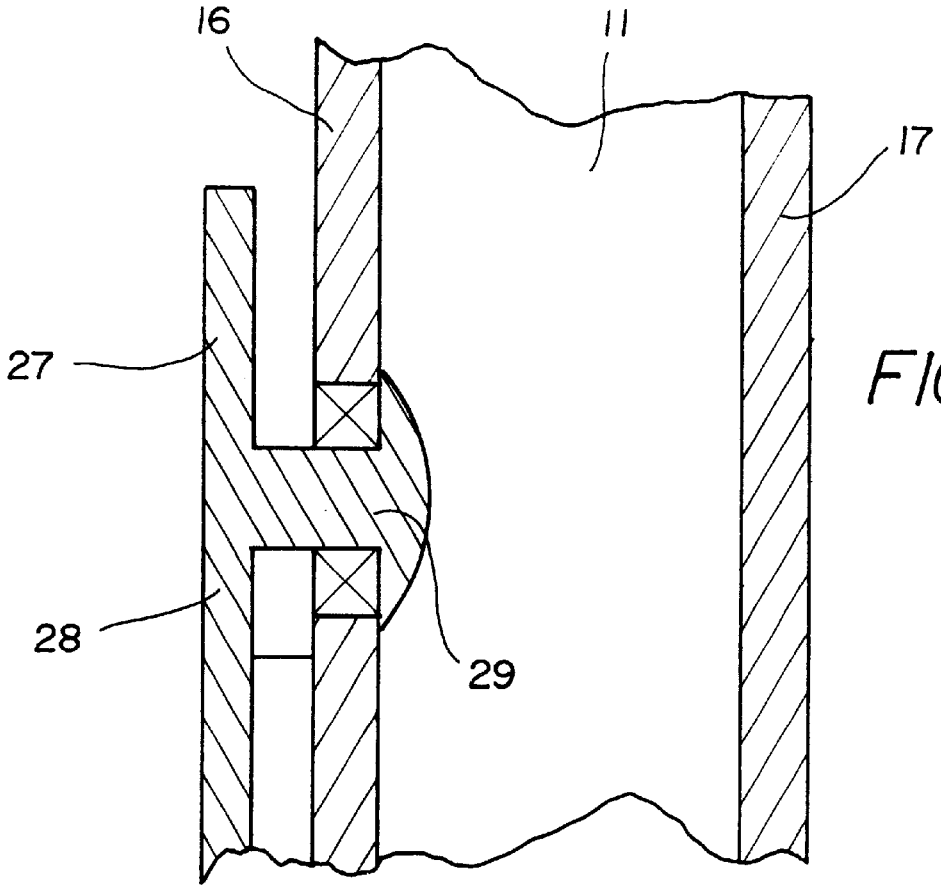
FIG. 3 is a detailed cross-sectional view of one of the bracket members and hinged member being attached to one of the elongate step support members of the present invention.
Figure 4:
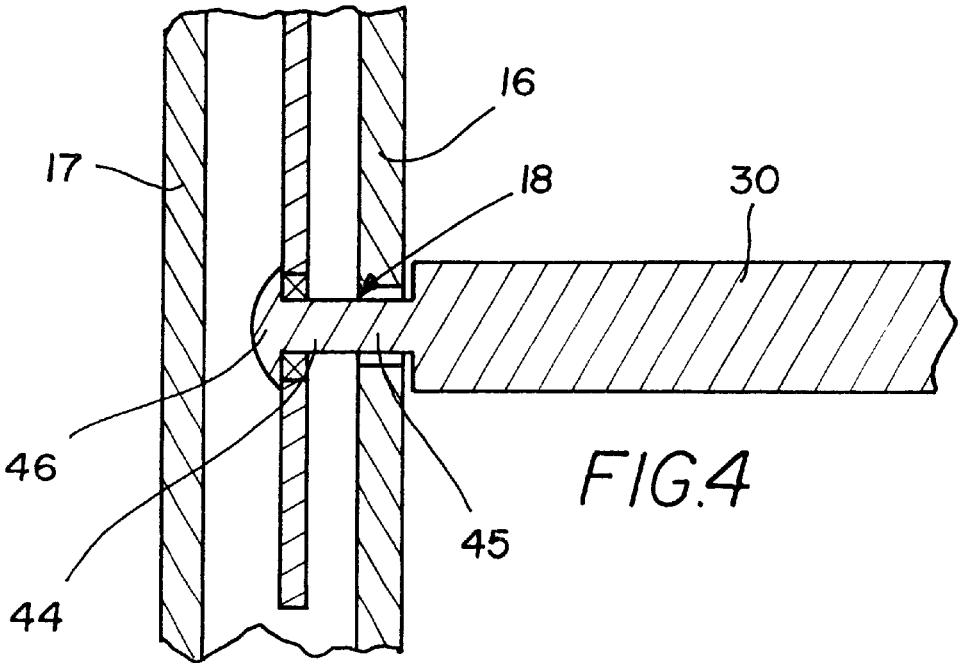
FIG. 4 is a detailed cross-sectional view one of the step members being mounted to one of the elongate step support members of the present invention.
Figure 5:
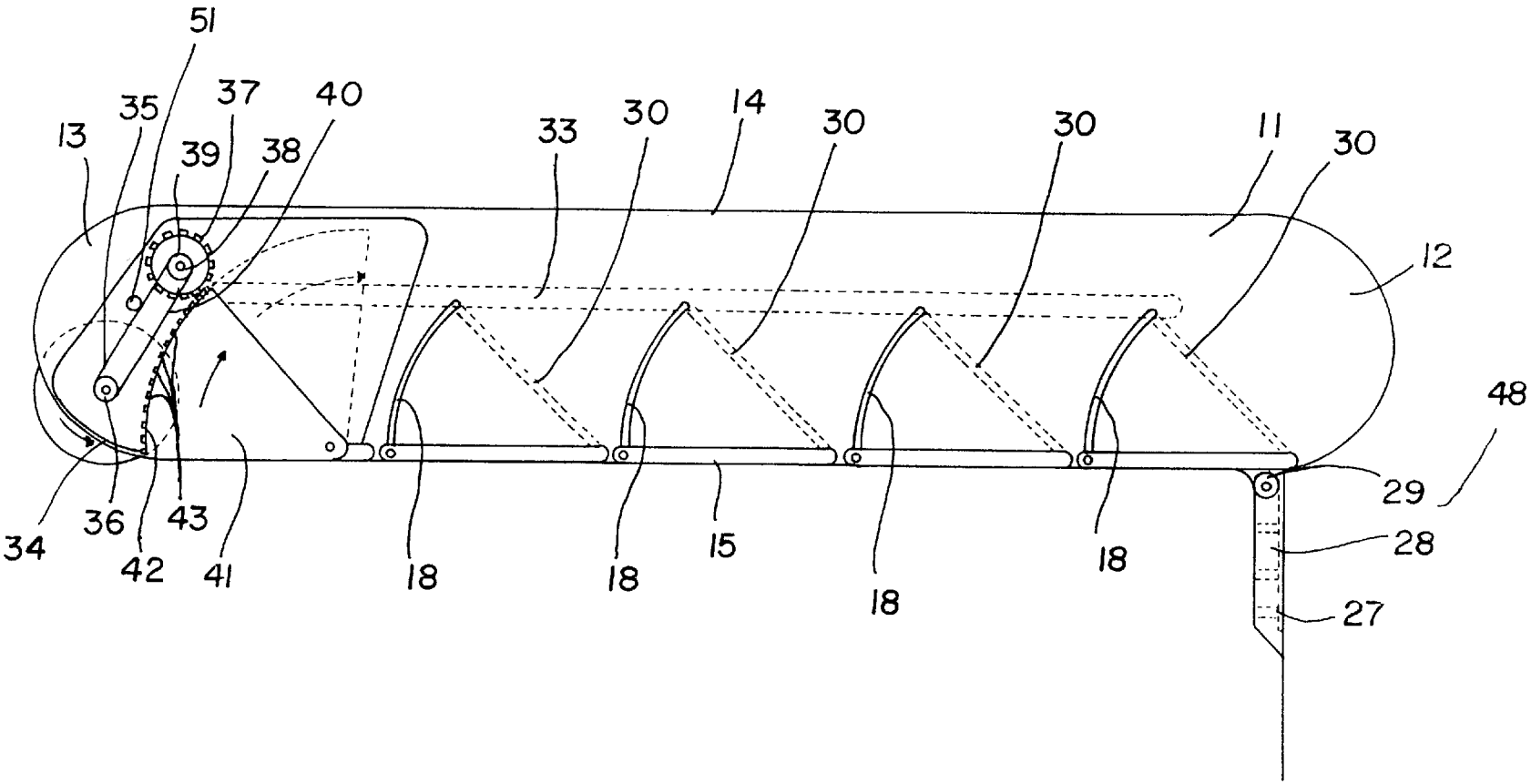
FIG. 5 is a cross-sectional view of the second embodiment of the present invention.

With reference now to the drawings, and in particular to FIGS. 1 through 5 thereof, a new combination step and ramp apparatus for floating docks embodying the principles and concepts of the present invention and generally designated by the reference numeral 10 will be described.

As best illustrated in FIGS. 1 through 5, the combination step and ramp apparatus for floating docks 10 generally comprises a pair of elongate step support members 11,19 being spaced apart with each of the elongate step support members 11,19 having a top end 12,20 and a bottom end 13,21. Each of the elongate step support members 11,19 also has first 16,24 and second 17,25 side walls being spaced apart and having an edge securely and conventionally attached to the side walls 16,17,24,25 and being disposed therebetween. Each of the elongate step support members 11,19 further has a longitudinal top edge 14,22 and a longitudinal bottom edge 15,23 with the first side walls 16,24 of the elongate step support members 11,19 being essentially disposed between the second side walls 17,25 of the elongate step support members 11,19. Each of the first side walls 16,24 has a plurality of arcuate slots 18 being spaced along a length thereof and being disposed therein with the arcuate slots 18 being disposed generally parallel to one another. Each of the arcuate slots 18 begins near the top longitudinal edge 14,22 and ends near the bottom longitudinal edge 15,23 of a respective the elongate step support member 11,19.

A bracket assembly 27 is hingedly and conventionally attached to the elongate step support members 11,19 and is adapted to be securely and conventionally attached and bolted to a boat landing 48 for allowing the elongate step support members 11,19 to pivot about the boat landing 48. The bracket assembly 27 includes bracket members 28 being adapted to securely attach with fasteners to a side wall of the boat landing 48, and also includes hinge members 29 each being securely attached to a respective bracket member 28 and to a respective elongate step support member 11,19 near the top end 12,20 thereof.

A plurality of step members 30 are laterally spaced along a length of the elongate step support members 11,19 with each of the step members 30 having a front end 31 and a back end 32 which is pivotally and conventionally attached to the elongate step support members 11,19. Each front end 31 of a respective step member 30 is adjustable such that the step member 30 maintains a generally horizontal orientation. Each of the step members 30 includes bolt-shaped extended portions 44 integrally extending outwardly from side ends at the front end 31 thereof and being movably and securely disposed in a respective arcuate slot 18. Each of the bolt-shaped extended portions 44 includes a shaft portion 45 and a head portion 46 disposed at an end of the shaft portion 45 with the shaft portion 45 extending through a respective arcuate slot 18 and with the head portion 46 being movably disposed between the first and second side walls 16,17,24,25 of a respective elongate step support member 11,19.

As a first embodiment, a step adjustment assembly for adjusting the step members 30 includes elongate step connecting members 33 movably and adjustably disposed between the first and second side walls 16,17,24,25 of the elongate step support members 11,19 and being conventionally connected to the bolt-shaped extended portions 44 for moving the step members 30 simultaneously to adjust the front ends 31 of the step members 30, and also includes wheels 34 being conventionally mounted at the bottom ends 13,21 of the elongate step support members 11,19.

As a second embodiment, the step adjustment assembly also includes wheels 34 being conventionally disposed at the bottom ends 13,21 of the elongate step support members 11,19 and being adapted to rest upon a floating dock 47, and also includes wheel axles 35 upon which the wheels 34 are rotatably mounted with the wheel axles 35 being securely and conventionally mounted to the elongate step support members 11,19, and further includes first sprockets 36 conventionally mounted to the wheel axles 35, and also includes gear members 37 rotatably disposed between the first and second side walls 16,17,24,25, and further includes shaft members 38 upon which the gear members 37 are rotatably and conventionally mounted with the shaft members 38 being securely and conventionally mounted to the elongate step support members 11,19, and also includes second sprockets 39 conventionally mounted to the shaft members 38, and further includes endless chains 40 being carried by the first and second sprockets 36,39, and also includes cams 41 being pivotally and conventionally mounted to the elongate step support members 11,19 and being conventionally attached to the elongate step connecting members 33 and being engageable to the gear members 37 for moving the elongate step connecting members 33 relative to the elongate step support members 11,19 for adjusting the positioning of the front ends 31 of the step members 30, and further includes tensioning sprockets 51 securely and conventionally mounted between the first and second side walls 16,17,24,25 and being engageable to the endless chains 40. Each of the cams 41 includes an arcuate edge 42 having a plurality of teeth 43 disposed therealong with the teeth 43 being engageable to a respective gear member 37 for pivotally moving the cam 41 according to the rising and falling of the floating dock 47 relative to the boat landing 48.

The combination step and ramp apparatus 10 also includes handrails 49,50 being securely and conventionally mounted to the elongate step support members 11,19 and extending upwardly therefrom for a user to hold onto as the user moves upon the step members 30.

In use, the pivotally attaches the top ends 12,20 of the elongate step support members 11,19 to the boat landing 48 and rests the bottom ends 13,21 of the elongate step support members 11,19 upon a floating dock 47. As the tides of the water rises and lowers so does the floating dock 47. When this happens, the bottom ends 13,21 of the elongate step support members 11,19 also rises and lowers. In order for the step members 30 to maintain a horizontal orientation during all of this, the front ends 31 of the step members 30 need to be adjusted accordingly. As the floating docks 47 rise, the steps members 30 become orientated more like a ramp, and as the floating docks 47 fall, the step members 30 become oriented like conventional steps so that in each instance the user will be able to go from the floating dock 47 to the boat landing 48 safely. As for the second embodiment, as the floating dock 47 rises, the wheels 34 rotate clockwise causing the gear members 37 to rotate counterclockwise thus pivoting the cams 41 downwardly and moving the elongate step connecting members 33 toward the bottom ends 13,21 of the elongate step support members 11,19 and moving the steps members 30 into a general ramp orientation. As the floating dock 47 falls, the wheels 34 rotate counterclockwise causing the gear members 37 to rotate clockwise thus pivoting the cams 41 upwardly and moving the elongate step connecting members 33 toward the top ends 12,20 of the elongate step support members 11,19 and moving the step members 30 into a conventional step orientation. In any event, the step members 30 maintain a substantial horizontal orientation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination step and ramp apparatus for floating docks comprising:

a pair of elongate step support members being spaced apart with each of said elongate step support members having a top end and a bottom end;

a bracket assembly being securely attached to said elongate step support members and being adapted to be hingedly attached to a boat landing for allowing said elongate step support members to pivot about the boat landing;

a plurality of step members being laterally spaced along a length of said elongate step support members with each of said step members having a front end and a back end which is pivotally attached to said elongate step support members, each said front end of a respective said step member being adjustable such that said step member maintains a generally horizontal orientation; and a step adjustment assembly for adjusting said step members;

wherein each of said elongate step support members has first and second side walls, each of said first side walls having a plurality of arcuate slots being spaced along a length thereof and being disposed therein, and wherein each of said step members includes extended portions extending outwardly from side ends at said front end thereof and being movably disposed in a respective said arcuate slot.

2. A combination step and ramp apparatus for floating docks as described in claim 1, wherein said first and second side walls are spaced apart and an edge extends between said side walls.

3. A combination step and ramp apparatus for floating docks as described in claim 1, wherein each of said elongate step support members has a longitudinal top edge and a longitudinal bottom edge.

4. A combination step and ramp apparatus for floating docks as described in claim 1, wherein said first side walls of said elongate step support members are disposed between said second side walls of said elongate step support members.

5. A combination step and ramp apparatus for floating docks comprising:

a pair of elongate step support members being spaced apart with each of said elongate step support members having a top end and a bottom end;

a bracket assembly being securely attached to said elongate step support members and being adapted to be hingedly attached to a boat landing for allowing said elongate step support members to pivot about the boat landing;

a plurality of step members being laterally spaced along a length of said elongate step support members with each of said step members having a front end and a back end which is pivotally attached to said elongate step support members, each said front end of a respective said step member being adjustable such that said step member maintains a generally horizontal orientation; and a step adjustment assembly for adjusting said step members;

wherein each of said elongate step support members has first and second side walls being spaced apart and has an edge securely attached to said side walls and being disposed therebetween;

wherein each of said elongate step support members has a longitudinal top edge and a longitudinal bottom edge;

wherein said first side walls of said elongate step support members are essentially disposed between said second side walls of said elongate step support members;

wherein each of said first side walls has a plurality of arcuate slots being spaced along a length thereof and being disposed therein, said arcuate slots being disposed generally parallel to one another;

wherein each of said arcuate slots begins near said top longitudinal edge and ends near said bottom longitudinal edge of a respective said elongate step support member.

6. A combination step and ramp apparatus for floating docks as described in claim 5, wherein said bracket assembly includes bracket members being adapted to securely attach with fasteners to a side wall of the boat landing, and also includes hinge members each being securely attached to a respective said bracket member and to a respective said elongate step support member near said top end thereof.

7. A combination step and ramp apparatus for floating docks as described in claim 5, wherein each of said step members includes extended portions extending outwardly from side ends at said front end thereof and being movably and securely disposed in a respective said arcuate slot.

8. A combination step and ramp apparatus for floating docks as described in claim 7, wherein each of said extended portions includes a shaft portion and a head portion disposed at an end of said shaft portion, said shaft portion extending through a respective said arcuate slot with said head portion being movably disposed between said first and second side walls of a respective said elongate step support member.

9. A combination step and ramp apparatus for floating docks as described in claim 7, wherein said step adjustment assembly includes elongate step connecting members movably and adjustably disposed between said first and second side walls of said elongate step support members and being connected to said extended portions for moving said step members simultaneously to adjust said front ends of said step members.

10. A combination step and ramp apparatus for floating docks as described in claim 9, wherein said step adjustment assembly also includes wheels being disposed at said bottom ends of said elongate step support members and being adapted to rest upon a floating dock, and also includes wheel axles upon which said wheels are rotatably mounted with said wheel axles being securely mounted to said elongate step support members, and further includes first sprockets mounted to said wheel axles, and also includes gear members rotatably disposed between said first and second side walls, and further includes shaft members upon which said gear members are rotatably mounted with said shaft members being securely mounted to said elongate step support members, and also includes second sprockets mounted to said shaft members, and further includes endless chains being carried by said first and second sprockets, and also includes cams being pivotally mounted to said elongate step support members and being attached to said elongate step connecting members and being engageable to said gear members for moving said elongate step connecting members relative to said elongate step support members for adjusting the positioning of said front ends of said step members.

11. A combination step and ramp apparatus for floating docks as described in claim 10, wherein each of said cams includes an arcuate edge having a plurality of teeth disposed therealong, said teeth being engageable to a respective said gear member for pivotally moving said cam according to the rising and falling of the floating dock relative to the boat landing.

12. A combination step and ramp apparatus for floating docks as described in claime 5, further includes handrails securely mounted to said elongate step support members and extending upwardly therefrom for a user to hold onto as the user moves upon the step members.

13. A combination step and ramp apparatus for floating docks comprising:

a pair of elongate step support members being spaced apart with each of said elongate step support members having a top end and a bottom end, each of said elongate step support members having first and second side walls being spaced apart and having an edge securely attached to said side walls and being disposed therebetween, each of said elongate step support members having a longitudinal top edge and a longitudinal bottom edge, said first side walls of said elongate step support members being essentially disposed between said second side walls of said elongate step support members, each of said first side walls having a plurality of arcuate slots being spaced along a length thereof and being disposed therein, said arcuate slots being disposed generally parallel to one another, each of said arcuate slots begining near said top longitudinal edge and ending near said bottom longitudinal edge of a respective said elongate step support member;

a bracket assembly being securely attached to said elongate step support members and being adapted to be hingedly attached to a boat landing for allowing said elongate step support members to pivot about the boat landing, said bracket assembly including bracket members being adapted to securely attach with fasteners to a side wall of the boat landing, and also including hinge members each being securely attached to a respective said bracket member and to a respective said elongate step support member near said top end thereof;

a plurality of step members being laterally spaced along a length of said elongate step support members with each of said step members having a front end and a back end which is pivotally attached to said elongate step support members, each said front end of a respective said step member being adjustable such that said step member maintains a generally horizontal orientation, each of said step members including bolt-shaped extended portions extending outwardly from side ends at said front end thereof and being movably and securely disposed in a respective said arcuate slot, each of said bolt-shaped extended portions including a shaft portion and a head portion disposed at an end of said shaft portion, said shaft portion extending through a respective said arcuate slot with said head portion being movably disposed between said first and second side walls of a respective said elongate step support member;

a step adjustment assembly for adjusting said step members including elongate step connecting members movably and adjustably disposed between said first and second side walls of said elongate step support members and being connected to said bolt-shaped extended portions for moving said step members simultaneously to adjust said front ends of said step members; and handrails securely mounted to said elongate step support members and extending upwardly therefrom for a user to hold onto as the user moves upon the step members.

14. A combination step and ramp apparatus for floating docks as described in claim 13, wherein said step adjustment assembly also includes wheels being disposed at said bottom ends of said elongate step support members and being adapted to rest upon a floating dock, and also includes wheel axles upon which said wheels are rotatably mounted with said wheel axles being securely mounted to said elongate step support members, and further includes first sprockets mounted to said wheel axles, and also includes gear members rotatably disposed between said first and second side walls, and further includes shaft members upon which said gear members are rotatably mounted with said shaft members being securely mounted to said elongate step support members, and also includes second sprockets mounted to said shaft members, and further includes endless chains being carried by said first and second sprockets, and also includes cams being pivotally mounted to said elongate step support members and being attached to said elongate step connecting members and being engageable to said gear members for moving said elongate step connecting members relative to said elongate step support members for adjusting the positioning of said front ends of said step members, each of said cams including an arcuate edge having a plurality of teeth disposed therealong, said teeth being engageable to a respective said gear member for pivotally moving said cam according to the rising and falling of the floating dock relative to the boat landing.

15. A combination step and ramp apparatus for floating docks as described in claim 1, wherein each of said arcuate slots begins near said top longitudinal edge and ends near said bottom longitudinal edge of a respective said elongate step support member.

16. A combination step and ramp apparatus for floating docks as described in claim 1, wherein each of said extended portions includes a shaft portion and a head portion disposed at an end of said shaft portion, said shaft portion extending through a respective said arcuate slot with said head portion being movably disposed between said first and second side walls of a respective said elongate step support member.

17. A combination step and ramp apparatus for floating docks as described in claim 16, wherein said step adjustment assembly includes elongate step connecting members movably and adjustably disposed between said first and second side walls of said elongate step support members and being connected to said extended portions for moving said step members simultaneously to adjust said front ends of said step members.

18. A combination step and ramp apparatus for floating docks as described in claim 17, wherein said step adjustment assembly also includes wheels being disposed at said bottom ends of said elongate step support members and being adapted to rest upon a floating dock, and also includes wheel axles upon which said wheels are rotatably mounted with said wheel axles being securely mounted to said elongate step support members, and further includes first sprockets mounted to said wheel axles, and also includes gear members rotatably disposed between said first and second side walls, and further includes shaft members upon which said gear members are rotatably mounted with said shaft members being securely mounted to said elongate step support members, and also includes second sprockets mounted to said shaft members, and further includes endless chains being carried by said first and second sprockets, and also includes cams being pivotally mounted to said elongate step support members and being attached to said elongate step connecting members and being engageable to said gear members for moving said elongate step connecting members relative to said elongate step support members for adjusting the positioning of said front ends of said step members.

* * * * *